US006926646B1

(12) United States Patent
Nguyen

(10) Patent No.: US 6,926,646 B1
(45) Date of Patent: Aug. 9, 2005

(54) EXERCISE APPARATUS

(76) Inventor: Hieu T. Nguyen, 14219 SE. Oak St., Portland, OR (US) 97233

( * ) Notice: Subject to any disclaimer, the term of this patent is extended or adjusted under 35 U.S.C. 154(b) by 627 days.

(21) Appl. No.: 09/712,305

(22) Filed: Nov. 13, 2000

(51) Int. Cl.[7] ..... A63B 21/00
(52) U.S. Cl. ..... 482/71; 48/70; 48/51
(58) Field of Search ..... 482/57, 70, 51–53, 482/79–80, 54, 901–903

(56) References Cited

U.S. PATENT DOCUMENTS

| | | | | |
|---|---|---|---|---|
| 4,720,093 | A | 1/1988 | Del Mar | |
| 5,033,733 | A | 7/1991 | Findlay | |
| 5,135,447 | A | 8/1992 | Robards, Jr. et al. | |
| 5,203,751 | A * | 4/1993 | Chang | 482/70 |
| 5,290,211 | A | 3/1994 | Stearns | |
| 5,421,798 | A * | 6/1995 | Bond et al. | 482/1 |
| 5,536,225 | A * | 7/1996 | Neuberg et al. | 482/71 |
| 5,595,554 | A * | 1/1997 | Maresh | 482/52 |
| 5,792,029 | A * | 8/1998 | Gordon | 482/52 |
| 5,836,854 | A * | 11/1998 | Kuo | 482/52 |
| 5,839,995 | A | 11/1998 | Chen | |
| 5,876,307 | A | 3/1999 | Stearns et al. | |
| 5,879,271 | A | 3/1999 | Stearns et al. | |
| 5,882,281 | A * | 3/1999 | Stearns et al. | 482/51 |
| 6,045,488 | A * | 4/2000 | Eschenbach | 482/52 |
| 6,126,573 | A | 10/2000 | Eschenbach | |
| 6,152,859 | A | 11/2000 | Stearns | |
| 6,183,397 | B1 | 2/2001 | Stearns et al. | |
| 6,183,398 | B1 | 2/2001 | Rufino et al. | |
| 6,196,948 | B1 | 3/2001 | Stearns et al. | |
| 6,203,474 | B1 | 3/2001 | Jones | |
| 6,302,830 | B1 | 10/2001 | Stearns | |
| 6,368,252 | B1 | 4/2002 | Stearns | |
| 6,398,695 | B2 | 6/2002 | Miller | |
| 2001/0012811 | A1 | 8/2001 | Gordon | |
| 2001/0016541 | A1 | 8/2001 | Maresh et al. | |
| 2001/0023219 | A1 | 9/2001 | Arnold et al. | |

* cited by examiner

*Primary Examiner*—Jerome W. Donnelly
(74) *Attorney, Agent, or Firm*—Kolisch Hartwell, P.C.

(57) ABSTRACT

An exercise apparatus and method. Typically, the exercise apparatus includes a frame, and left and right pedals interconnected to the frame. The left and right pedals are adapted to be moved in any one of the following ways: in a substantially vertical direction, in a substantially horizontal direction, and simultaneously in a substantially vertical direction and a substantially horizontal direction. The apparatus may include a pedal support assembly interconnecting the pedals to the frame. The pedal support assembly typically includes a horizontal guide assembly configured to enable the pedals to move horizontally, and a vertical guide assembly configured to enable the pedals to move vertically. Additionally, the apparatus may include a resistance subsystem configured to selectively apply a resistance force against the motion of the pedals. The resistance subsystem may be used to limit motion of the pedals to a predefined pedal path within the range of motion.

18 Claims, 15 Drawing Sheets

EXERCISE APPARATUS

TECHNICAL FIELD

The present invention relates generally to exercise devices, and more particularly to an exercise device having pedals configured to move horizontally, vertically, or diagonally along virtually any path within a predefined range of motion.

BACKGROUND OF THE INVENTION

Over the years, a variety of exercise devices have been produced, including treadmills, stair-climbers, stationary bicycles, rowing machines, and elliptical trainers. Prior exercise devices such as these are configured to enable a user to repetitively move his or her body along a limited and unvariable path in order to approximate a walking, running, bicycling, climbing, skiing, or rowing motion.

Unfortunately, the repetitive motion of prior exercise devices along a single, limited and unvariable path has certain drawbacks, which may result in injury or a less pleasurable exercise experience for the user. First, only specific sets of muscles are exercised by motion along a single path of motion. This results in an unbalanced workout for the user, and may cause premature muscle fatigue, resulting in a shorter period of exercise. Second, repetitive motion may lend to injuries such as stress fractures, tendon and ligament damage, muscle pulls, etc. Third, repeating a single path over and over may become boring to the user, causing the user to exercise for short periods of time, or stop exercising altogether.

It would be desirable to provide an exercise apparatus that enables a user's feet to move horizontally, vertically, or diagonally along virtually any pedal path within a predefined range of motion, thereby reducing the injury and tedium associated with prior exercise devices.

SUMMARY OF THE INVENTION

An exercise apparatus and method are provided. Typically, the exercise apparatus includes a frame, and left and right pedals interconnected to the frame. The left and right pedals are adapted to be moved in any one of the following ways: in a substantially vertical direction, in a substantially horizontal direction, and simultaneously in a substantially vertical direction and a substantially horizontal direction. The apparatus may include a pedal support assembly interconnecting the pedals to the frame. The pedal support assembly typically includes a horizontal guide assembly configured to enable the pedals to move horizontally, and a vertical guide assembly configured to enable the pedals to move vertically. Each of the horizontal and vertical guide assemblies may include rollers and elongate guides. The apparatus may further include horizontal and vertical motion translation mechanisms configured to link the motion of the pedals such that the pedals to move in opposed, reciprocal directions. Additionally, the apparatus may include a resistance subsystem configured to selectively apply a resistance force against the motion of the pedals. The resistance subsystem may be used to limit motion of the pedals to a predefined pedal path within the range of motion.

According to another aspect of the invention, the exercise apparatus may include a frame and a pair of pedals interconnected to the frame. The exercise apparatus may further include a horizontal motion translation assembly coupled to each of the pedals and configured to link the horizontal motion of the pedals, and a vertical motion translation assembly coupled to each of the pedals and configured to link the vertical motion of the pedals.

According to another aspect of the invention, the exercise apparatus may include a frame and a pedal interconnected to the frame. The exercise apparatus may further include a horizontal guide configured to guide horizontal motion of the pedals, and a vertical guide configure guide vertical motion of the pedal.

According to another aspect of the invention, the exercise apparatus may include a frame, and a pair of pedals interconnected to the frame. The pedals are configured to move within a predefined range of motion. The exercise apparatus typically includes a resistance subsystem configured to constrain movement of the pedals to a predefined path within the predefined range of motion. The resistance subsystem may include an electromechanical resistance drive. The predefined path may be circular, elliptical, parallelogram-shaped, linear, curvilinear, vertical, horizontal, spiral, rectilinear, or other suitable predetermined shape.

The method typically includes configuring the pedals for free motion within a predefined range of motion, and constraining the motion of the pedals to a predefined pedal path within the predefined range of motion via a selectively applied resistance force.

DETAILED DESCRIPTION OF THE DRAWINGS

DETAILED DESCRIPTION OF THE INVENTION

Figure 1:
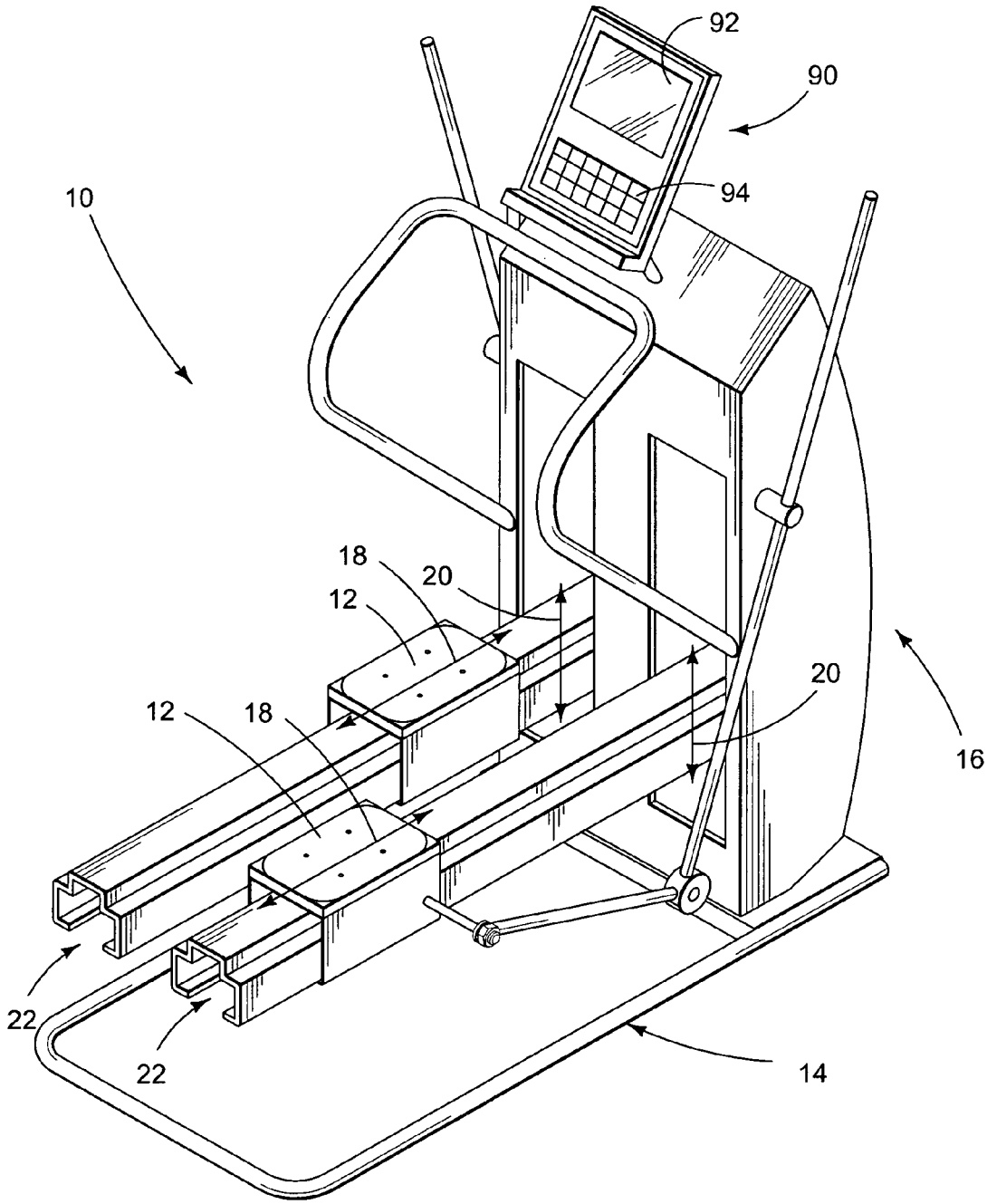
FIG. 1 is an isometric view of an exercise apparatus according to one embodiment of the present invention.

An exercise apparatus according to one embodiment of the present invention is shown in FIGS. 1–6, and generally indicated at 10. Exercise apparatus 10 includes left and right pedals 12 interconnected to a frame 14 by a pedal support assembly 16. Pedal support assembly 16 typically includes a pair of horizontal guide assemblies 22 configured to guide the motion of pedals 12 in a substantially horizontal direction 18, a pair of vertical guide assemblies 24 configured to guide the motion of the pedals 12 in a substantially vertical direction 20, and a motion translation mechanism 26 configured to link pedals 12 such that pedals 12 move reciprocally in opposite directions, around a constant geometric center 62.

Figure 2:
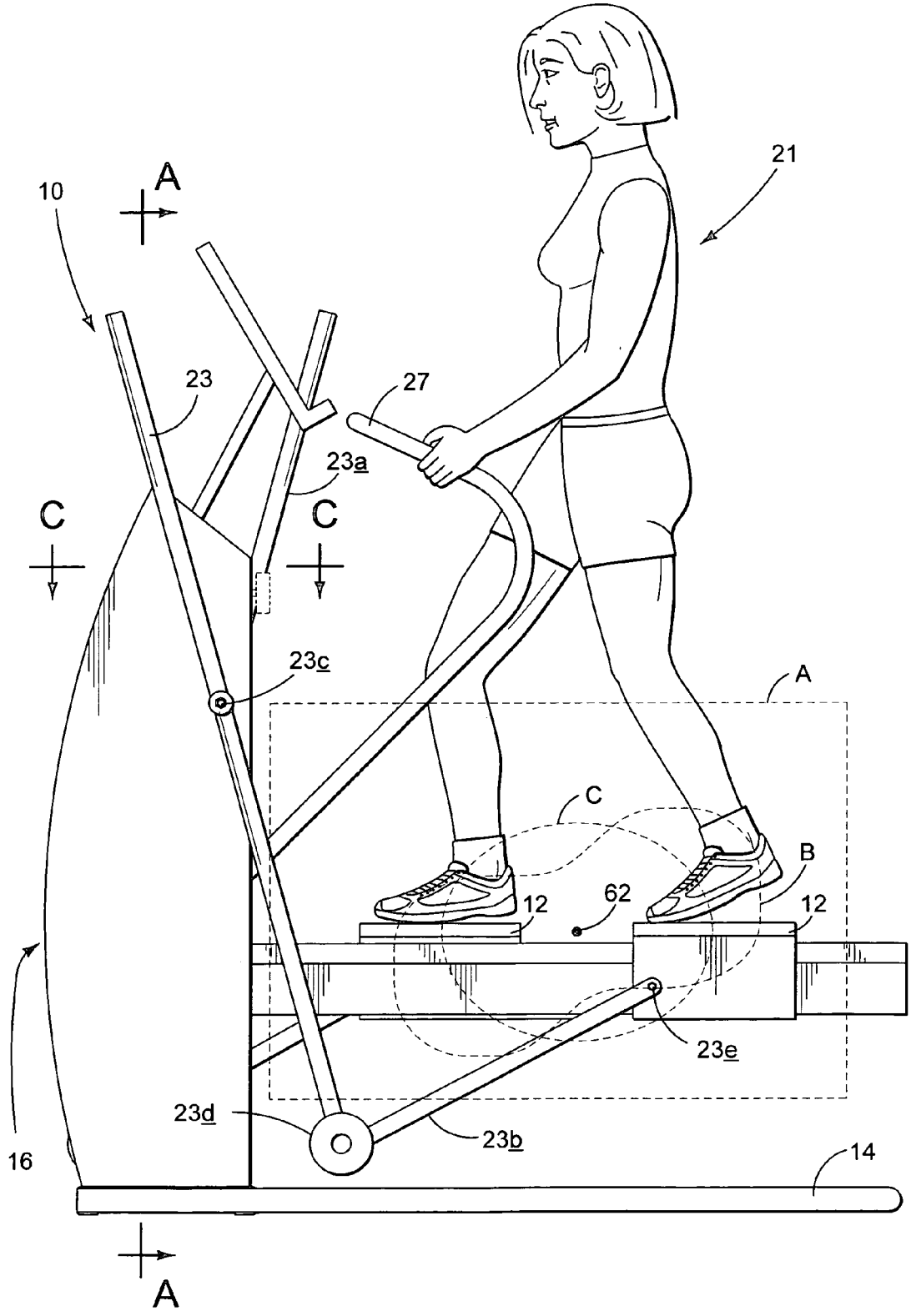
FIG. 2 is a side view of the exercise apparatus of FIG. 1.
Figure 3:
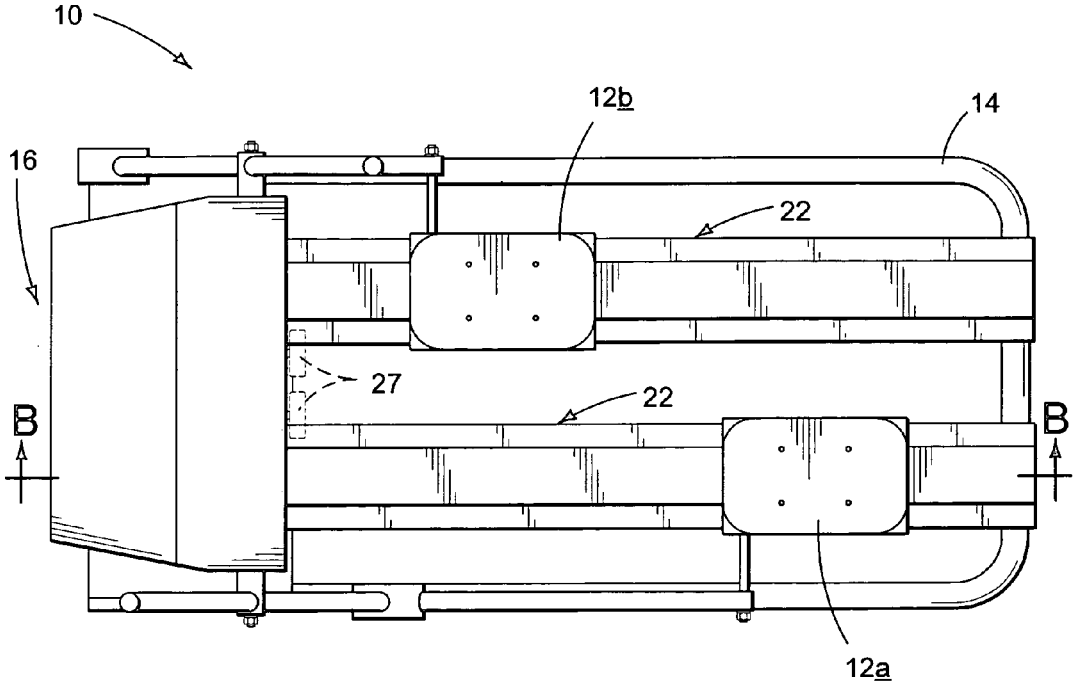
FIG. 3 is a top view of the exercise apparatus of FIG. 1.

As shown in FIG. 2, pedal support assembly 16 is configured to support pedals 12 such that each pedal is movable to any position within a predefined range of motion A. The pedal support assembly may be configured to move pedals 12 within predefined range A in one of two modes, a free movement mode and a constrained movement mode. In the free movement mode, the pedal support assembly is configured to enable pedals 12 to be moved by user 21 freely along an arbitrary pedal path B. Along the arbitrary pedal path, pedals 12 typically remain equidistant from geometric center 62. At any point on arbitrary pedal path B, user 21 may push pedals 12 in a desired direction. The user may move the pedals horizontally, vertically, or simultaneously horizontally and vertically, such that the pedals travel along a diagonal or curved path.

Figure 20:
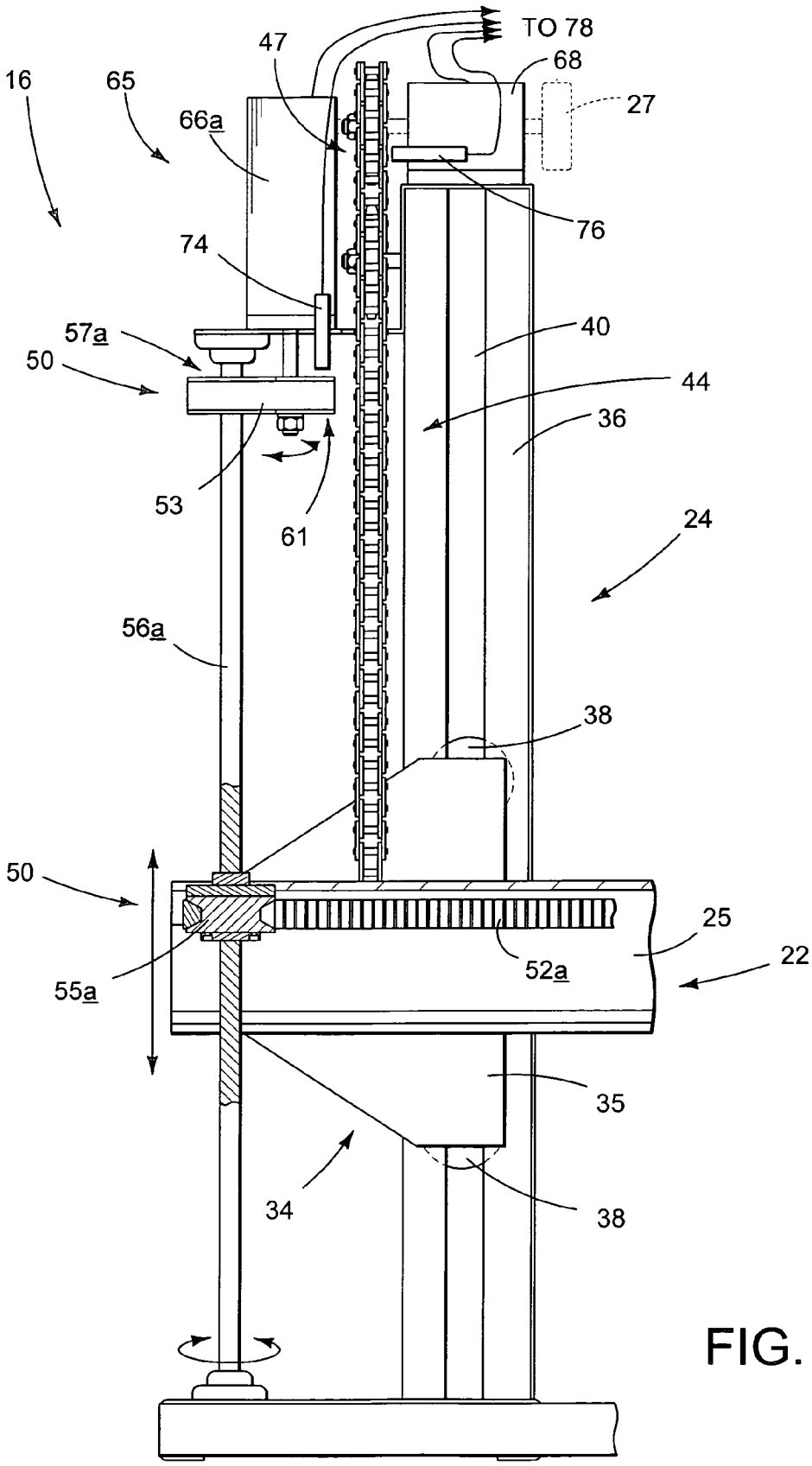
FIG. 20 is a partial sectional side view of the interface shown in FIG. 19.

In the constrained movement mode, the pedal support assembly provides pedals 12 the freedom of movement described above, however a resistance subsystem 65, shown in FIG. 20, acts to constrain the movement of the pedals to a predefined path C, within range of motion A. The predefined path C may be static, or may vary over time. Exemplary pedal paths C are shown in FIGS. 7–15, described below.

Each horizontal guide assembly 22 typically includes an elongate, horizontal guide 25 and a corresponding horizontal roller assembly 28 configured to slide longitudinally along the guide 25. Pedal 12 is attached to horizontal guide assembly 22, and is thereby configured to travel in a substantially horizontal direction along guide 25, as indicated by arrow 18 in FIG. 1.

Figure 16:
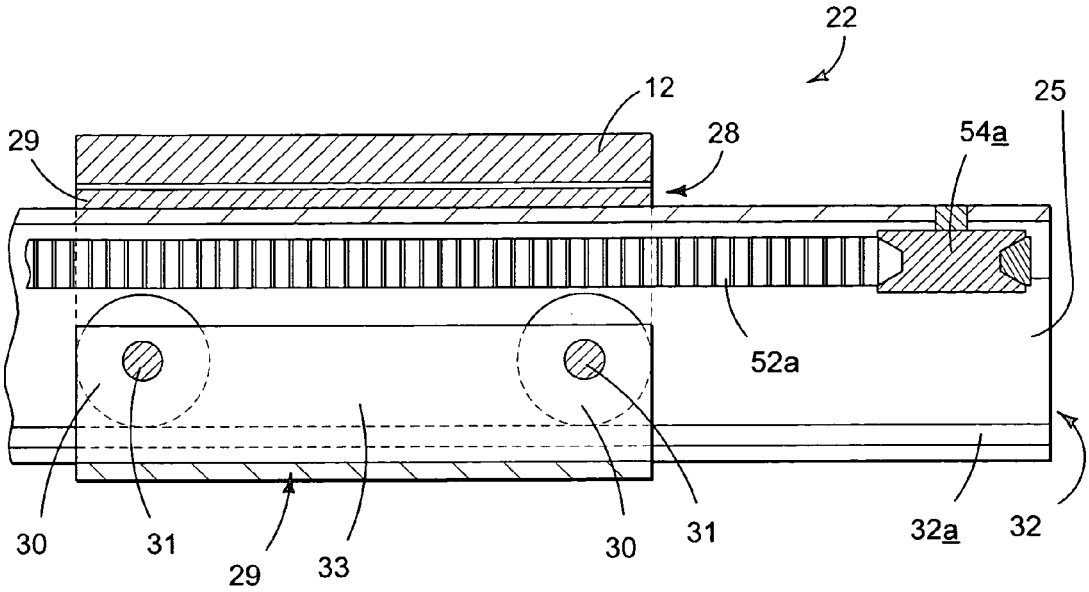
FIG. 16 is a partial sectional view of a pedal and horizontal guide assembly of the apparatus of FIG. 1, taken along line B—B of FIG. 3.
Figure 17:
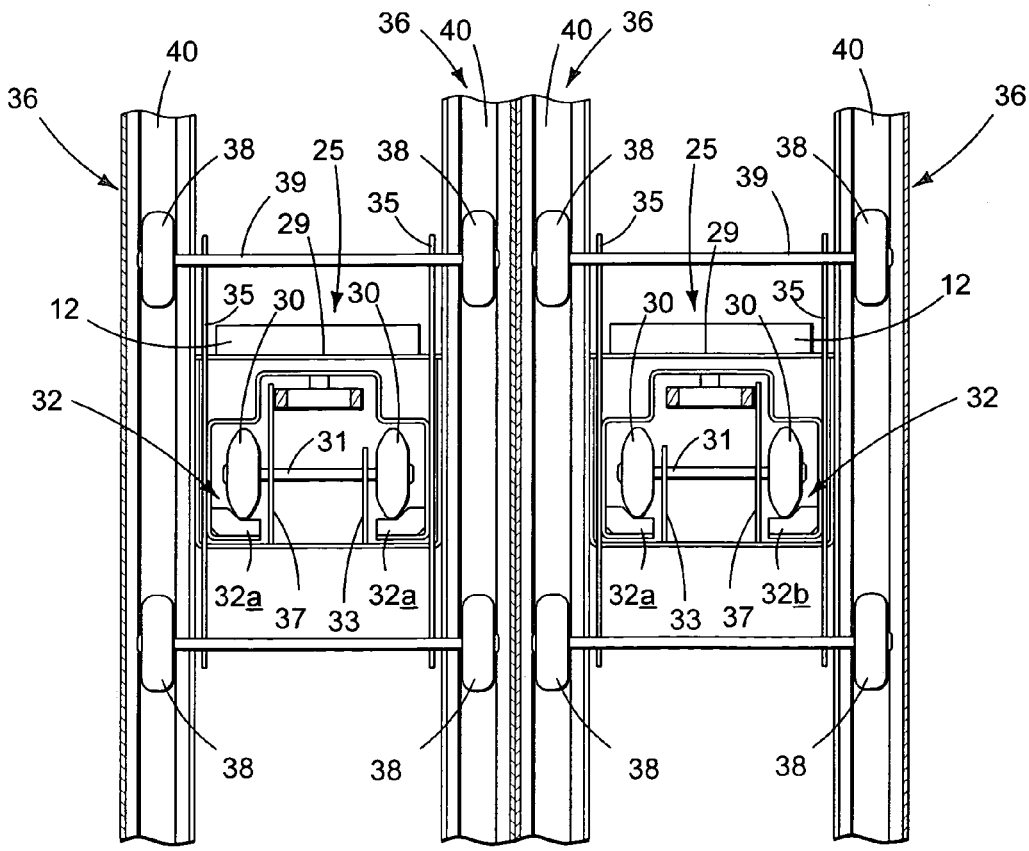
FIG. 17 is a partial sectional view of an interface of the horizontal guide assemblies and vertical guide assemblies of the apparatus of FIG. 1, taken along line A—A of FIG. 2.
Figure 18:
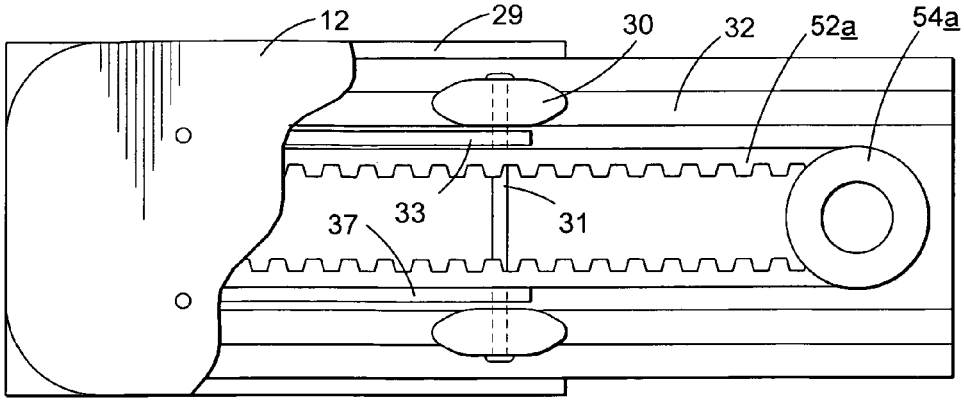
FIG. 18 is a cut-away top view of a portion a pedal and horizontal guide assembly of the apparatus of FIG. 1.

As shown in detail in FIGS. 16–18, horizontal guide 25 is typically formed to include opposed, inwardly facing C-shaped channels 32. Alternatively channels 32 may be outwardly or upwardly facing, and/or may be of another suitable shape, such as V-shaped or U-shaped. Channels 32 may include an alignment member 32*a* which is typically made of a Teflon material.

Each horizontal roller assembly 28 typically includes a frame 29 and a plurality of wheels 30 mounted to axles 31, which are rotatively coupled to frame 29 by flanges 33 and 37. Frame 29 typically extends around horizontal guide 25, hanging from flanges 33 and 37 below guide 25, and supporting pedal 12 above guide 25. Thus, force from a foot of user 21 on pedal 12 is transferred by frame 29 through axles 31 and wheels 30 to alignment member 32*a* and horizontal guide 25.

Alternatively, frame 29 may not extend around horizontal guide 25. For example, horizontal guide 25 may include a channel that opens upward, and frame 29 may be of a complimentary shape configured to ride in the channel, and may not wrap around guide 25.

Wheels 30 are adapted to travel within channels 32. Typically, wheels 30 are mounted to frame 29 in opposed pairs, however it will be appreciated that one row of wheels may also be used. Alternatively, instead of or in addition to wheels 30, it will be appreciated that ball bearings, Teflon skids, or other suitable sliding or rolling mechanism may be used to enable horizontal roller assembly 28 to slide relative to horizontal guide 25.

Figure 4:
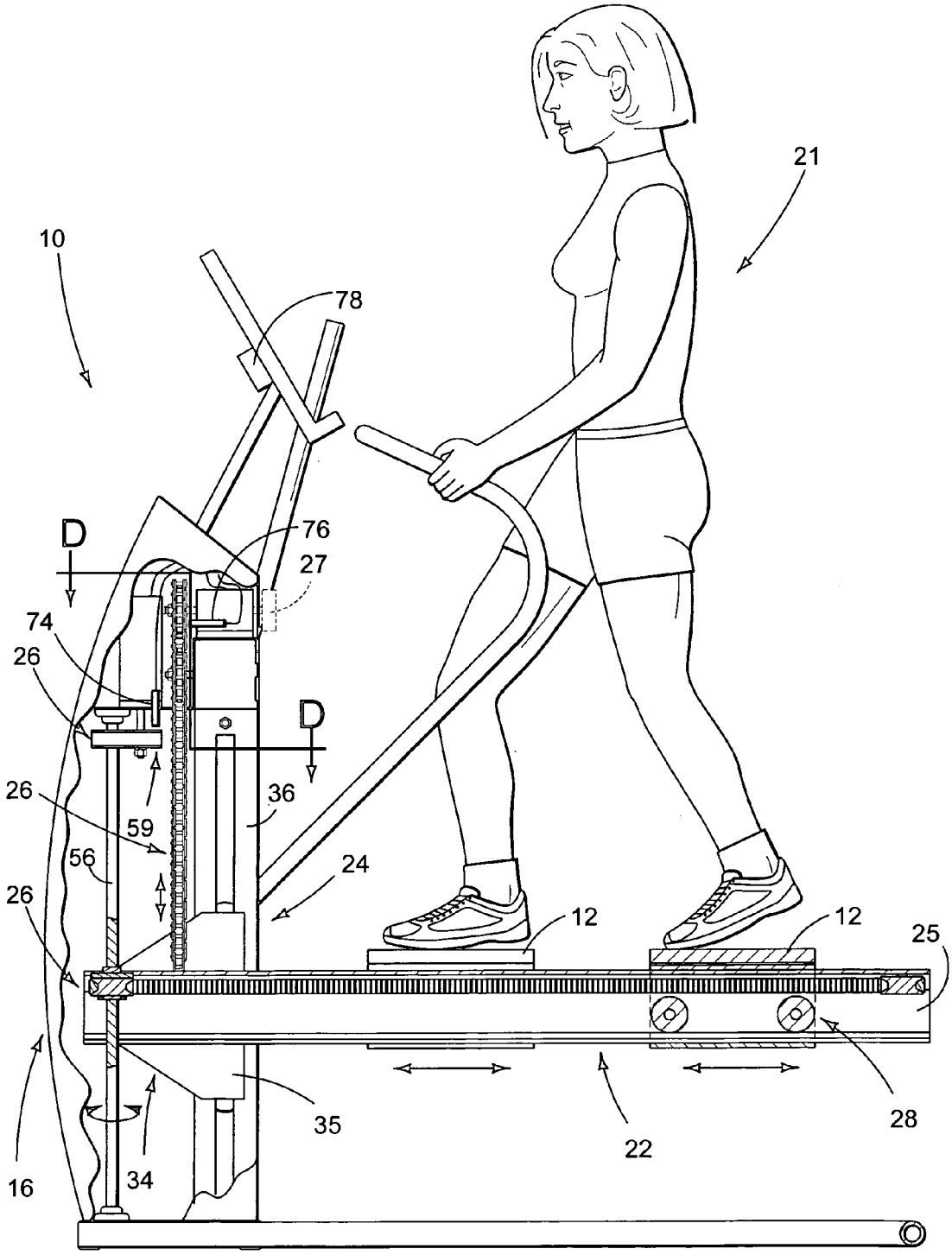
FIG. 4 is partial cut-away and sectional side view of the exercise apparatus of FIG. 1, the section taken along line B—B of FIG. 3.
Figure 19:
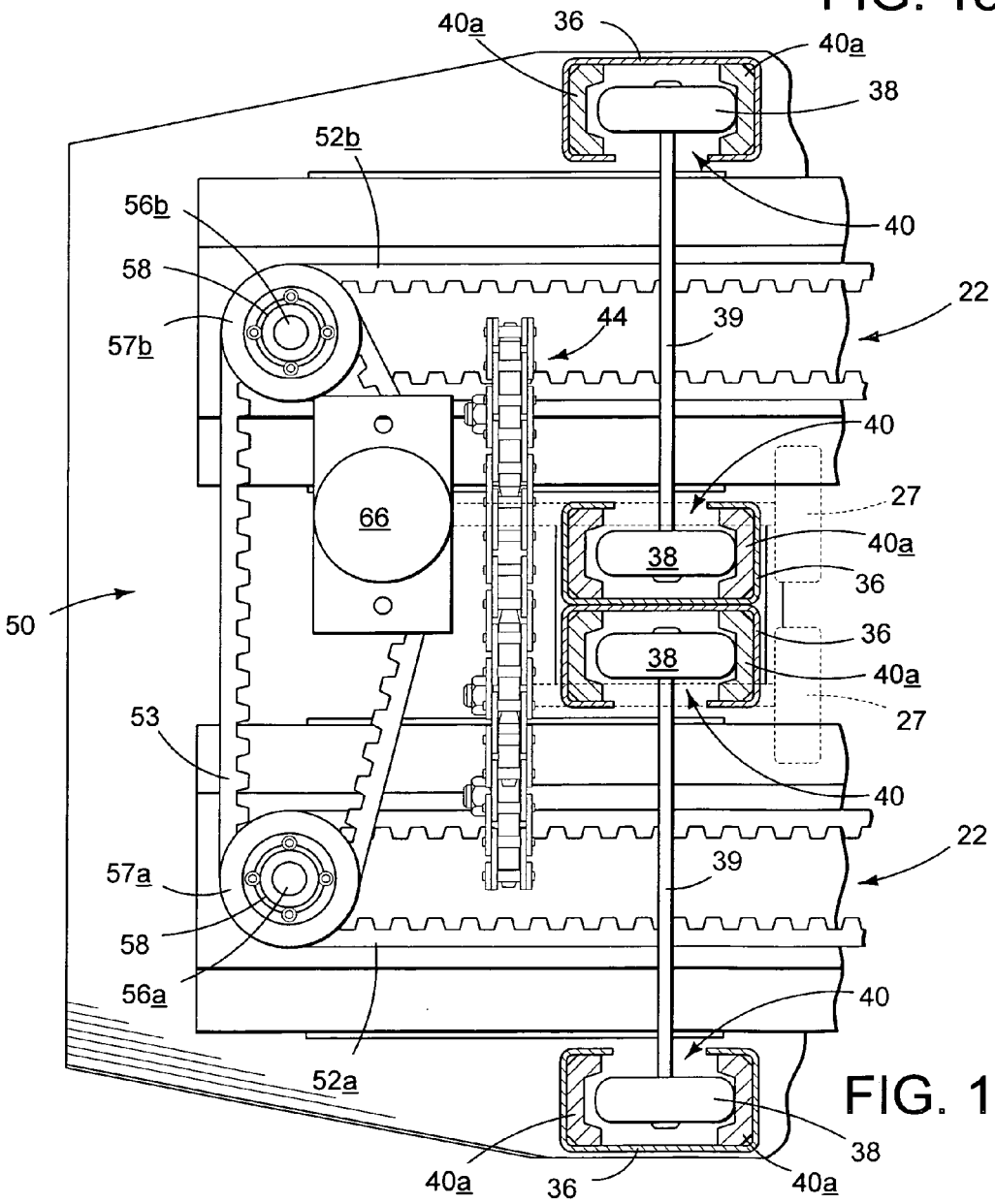
FIG. 19 is a detail cut-away top view of a portion of the interface of the horizontal guide assemblies and vertical guide assemblies of the apparatus of FIG. 1, taken along line D—D of FIG. 4.

As shown in FIG. 4, pedal support assembly 16 further includes motion translation assembly 26 configured to link the motion of the pedals. Motion translation mechanism 26 includes a horizontal motion translation linkage 50, shown in FIG. 19, configured to link the horizontal motion of the pedals and a vertical motion translation linkage 44 configured to link the vertical motion of the pedals.

Horizontal motion translation linkage 50 is configured to link in a reciprocal manner the longitudinal motion of the left and right pedals 12*a* and 12*b* via its constituent flexible tensile members (typically toothed belts) 52*a*, 52*b*, 53, rotating shafts 56*a*, 56*b* and pulleys 54*g*, 54*b*, 55*a*, 55*b*, 57*a*, 57*b*. These pulleys are typically toothed, although teeth are not shown in the Figures for simplicity. Belt 52*a* is coupled to a corresponding horizontal roller assembly 28 via flange 37. As the pedal 12*a* moves back and forth along the corresponding guide 25, the longitudinal motion of belt 52*a* within guide 25 is transferred to pulleys 54*a* and 55*a*. Pulley 55*a*, in turn, is configured to rotate shaft 56*a*. The rotational motion of shaft 56*a* is transferred to shaft 56*b* via pulleys 57*a*, 57*b*, and belt 53. Alternatively, the horizontal motion of pedals 12 may be linked by another suitable mechanism, such as the rack and pinion mechanism shown in FIG. 24. Any or all of belts 52*a*, 52*b*, 53 may alternatively be another suitable type of flexible tensile member such as a chain, cable, smooth belt, etc.

Vertical guide assembly 24 typically includes vertical roller assemblies 34 and vertical guides 36. Vertical roller assemblies 34 typically include mounting plates 35, wheels 38, and associated axles 39. Horizontal guide assemblies 22 are coupled to vertical guide assemblies 24 by mounting plates 35.

A sliding bearing 58 is typically mounted within each of pulleys 55*a* and 55*b* and enables the horizontal guide assemblies to slide up and down along rotating shafts 56*a*,

56*b*. Shafts 56*a* and 56*b* are typically channeled and the sliding bearing 58 is typically a ball spline bearing having ball bearings adapted to fit within the channels of shafts 56*a*, 56*b*. Thus, the sliding bearing 58 is configured to slide along shafts 56*a*, 56*b*, as well as impart rotative motion to the shafts. Alternatively, another suitable bearing may be used, which is configured to slide along and rotatively couple to shafts 56*a*, 56*b*.

Wheels 38 are adapted to roll within channels 40 of vertical guides 36. Due to the weight of horizontal guides 25 and downward force imparted by user 21, an upper set of wheels 38 typically rolls against inward sides of channels 40, and a lower set of wheels 38 typically rolls against outward sides of channels 40. Channels 40 typically include an alignment member 40*a* which may be a made of a Teflon material. While channels 40 typically face inward, it will be understood that the channels may face outward. Channels 40 are typically C-shaped, but may alternatively be another suitable shape such as V-shaped or U-shaped, etc. Vertical motion translation linkage 44 typically includes sprockets 46*a*, 46*b* and a flexible tensile member 48 mounted at each end to a respective horizontal guide assembly. Alternatively, the flexible tensile member 48 may be mounted to vertical guide assemblies 34, or at another suitable location. The flexible tensile member 48 is typically a chain, although another suitable flexible tensile member may be used, such as a cable, belt, etc. As one of the horizontal guide assemblies 22 is lowered, the flexible tensile member 48 acts to raise the other horizontal guide assembly in a reciprocal manner.

Horizontal guide assemblies 22, vertical guide assemblies 24, and the corresponding motion translation mechanisms 44, 50 interoperate to enable pedals 12 to be moved by user 21 in a substantially horizontal direction, a substantially vertical direction, and simultaneously in a horizontal and vertical direction such that the pedals 12 may travel along a diagonal or curved path within range of motion A. As described above, in the free movement mode, the user may direct the pedals to virtually any pair of opposed positions within range of motion A, substantially equidistant from geometric center 62, and may drive the pedals along virtually any arbitrary pedal path B. Because the pedals remain substantially equidistant from geometric center 62 along the arbitrary pedal path B, path B may be described as symmetric.

Exercise apparatus 10 further includes resistance subsystem 65. Resistance subsystem 65 typically includes a horizontal resistance mechanism 66 and vertical resistance mechanism 68. Horizontal resistance mechanism 66 typically includes a resistance drive 66*a* operatively coupled to a resistance pulley 61. Resistance drive 66*a* is typically an electromechanical motor, although a friction brake or hydraulic mechanism may be used to apply resistance. Resistance pulley 61 is typically toothed and intermeshes with belt 53 of horizontal motion translation linkage 50, thereby selectively imparting a resistance force acting against the horizontal motion of pedals 12. The horizontal resistance force may be varied via a manual horizontal resistance controller 27*a*, shown in FIG. 6. Alternatively, the horizontal resistance force may be varied by an electronic controller 78, described below.

Figure 5:
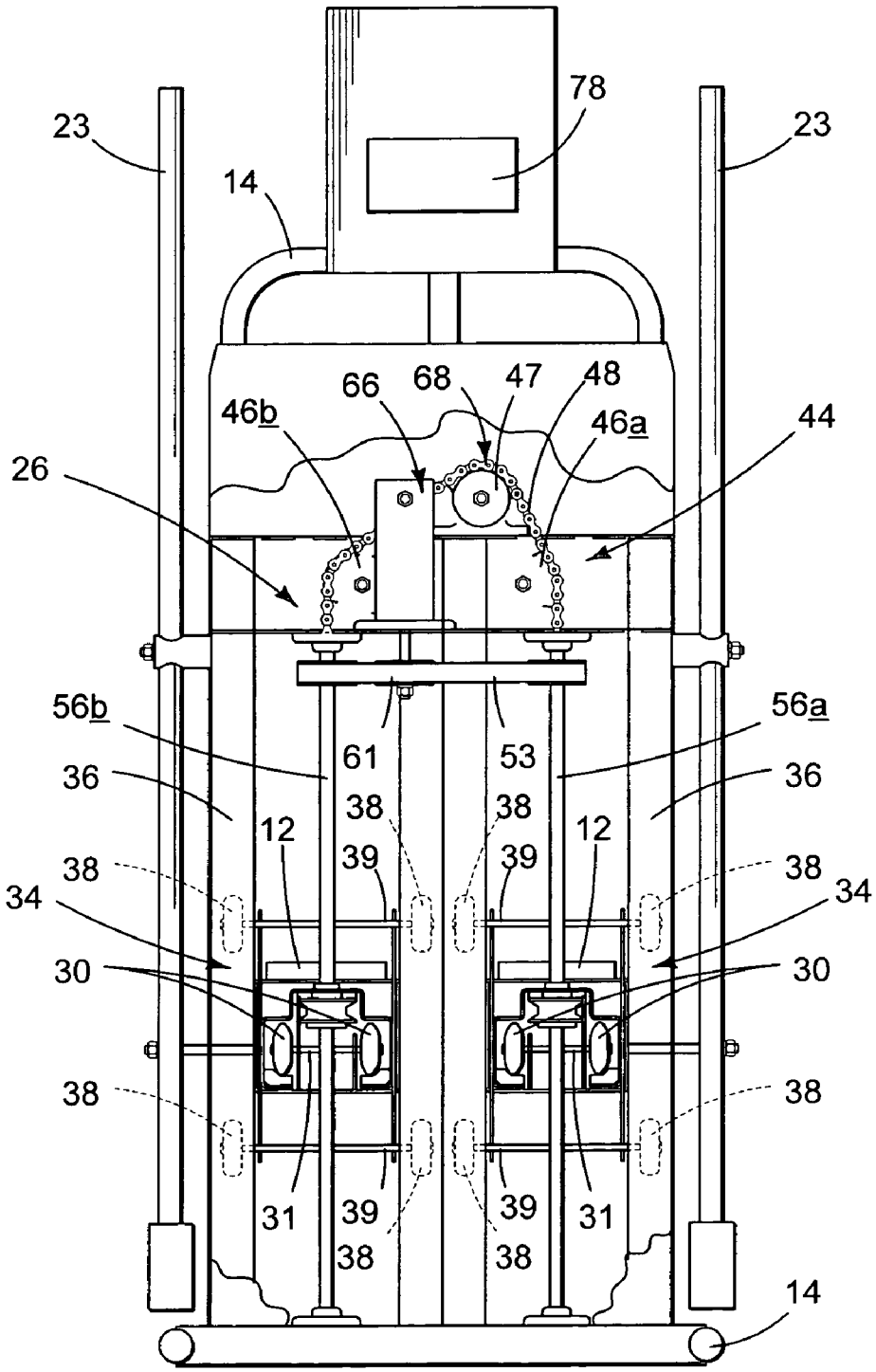
FIG. 5 is a cut-away end view of the exercise apparatus of FIG. 1.
Figure 6:
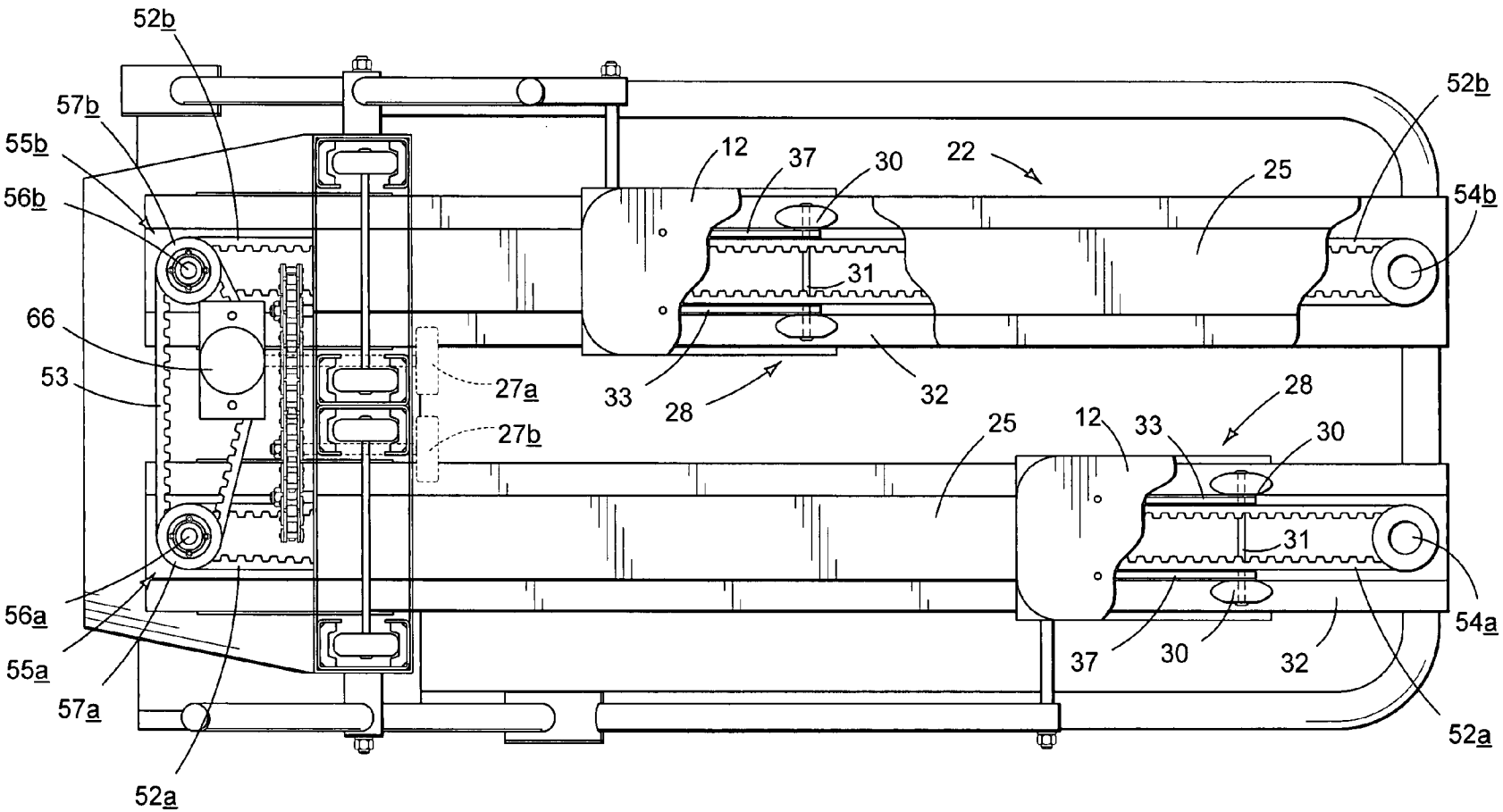
FIG. 6 is a partial cut-away top view of the exercise apparatus of FIG. 1.

Vertical resistance mechanism 68 typically includes a resistance drive 68*a* and a resistance sprocket 47, shown in FIG. 5. The resistance sprocket 47 intermeshes with chain 48 to apply a resistance force to the vertical motion of horizontal guide assemblies 22 and pedals 12. The vertical resistance force may be varied by a user by vertical resistance control 27*b*. Alternatively, the vertical resistance force may be controlled by electronic controller 78. Either or both of the horizontal and vertical resistance mechanisms may be configured to apply either constant or variable resistance forces. The resistance force may be varied over time based on a variety of factors such as the position of the pedals, speed of the pedals, direction of the pedals, etc.

According to an alternative embodiment of the invention, the resistance sprocket 47, or an idler sprocket in a similar position, may be configured to be raised and lowered, thereby decreasing and increasing the vertical travel distance of the vertical roller assemblies within the vertical guides. By raising and lowering the adjustable idler sprocket or resistance sprocket 47, a user may adjust the vertical distance that pedals 12 travel up and down.

The vertical and horizontal resistance mechanisms 66, 68 may be used to apply a resistance force to the pedals while the user is operating the pedals in the free movement mode, discussed above. In addition, the resistance mechanisms 66, 68 may be used to constrain the motion of the pedals to a predefined path C within range of motion A.

To accomplish this, exercise apparatus 10 typically includes an electronic controller 78 and associated horizontal and vertical position sensors 74, 76. Typically, the horizontal and vertical position sensors are typically optical position encoders, incorporating an optical reader and a spinning black and white disk. Alternatively, other suitable position sensors may be used. Controller 78 is linked to each of the position sensors and configured to ascertain the horizontal and vertical position of the pedals via sensors 74, 76.

Controller 78 is further configured to vary the resistance force applied through horizontal and vertical resistance mechanisms, based on the detected position of the pedals. Alternatively, the resistance force may be based on the motion of the pedals, including the speed and/or direction of the pedals, or on another suitable pedal motion parameter.

Controller 78 is typically configured to enable a user to select via a user interface 90 having a keyboard 94 and display 92, a predefined path C to follow while operating exercise apparatus 10 in constrained movement mode. The predefined pedal paths may be constant or variable over time, and may include constant or variable resistance. In addition, controller 78 is typically configured to enable user 21 to program his/her own path.

Figure 7:
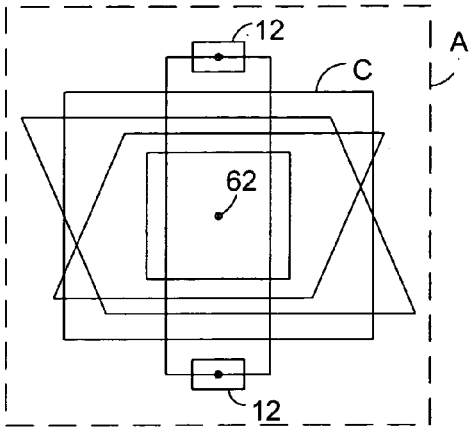
FIG. 7 is a schematic representation of predefined parallelogram pedal paths according to one embodiment of the present invention.
Figure 8:
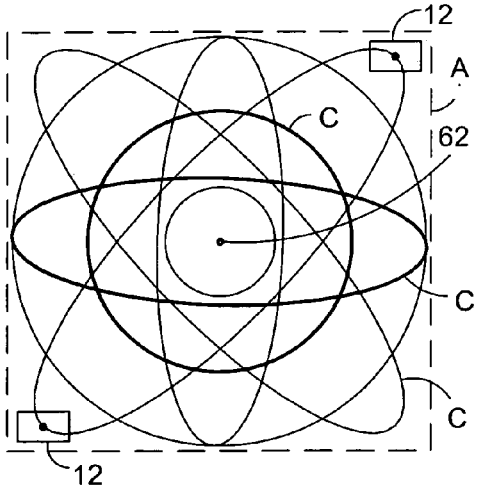
FIG. 8 is a schematic representation of predefined circular and elliptical pedal paths according to one embodiment of the present invention.
Figure 9:
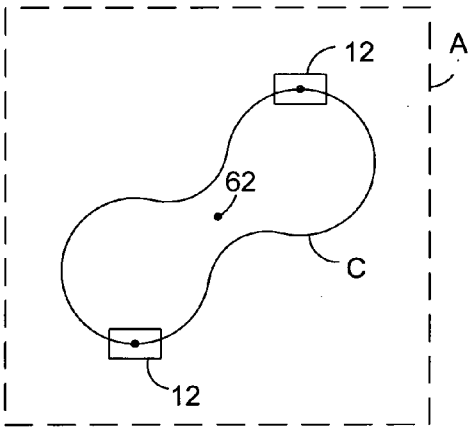
FIG. 9 is a schematic representation of a predefined curvilinear pedal path according to one embodiment of the present invention.
Figure 10:
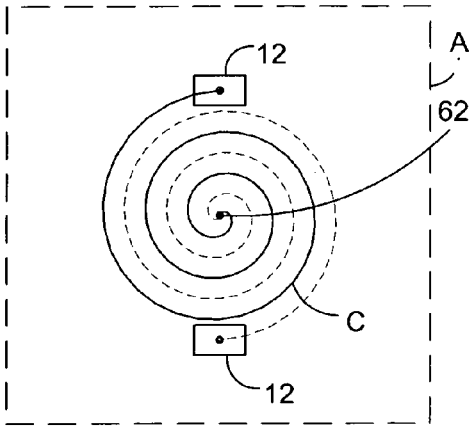
FIG. 10 is a schematic representation of a predefined spiral pedal path according to one embodiment of the present invention.
Figure 11:
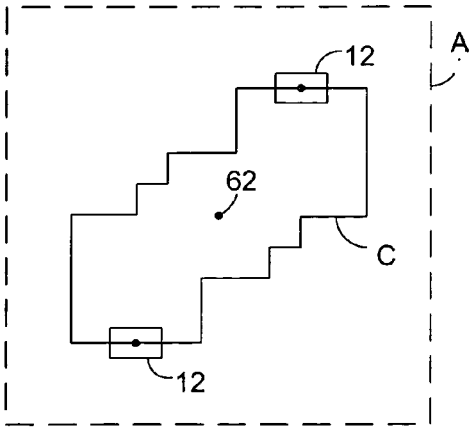
FIG. 11 is a schematic representation of a predefined rectilinear pedal path according to one embodiment of the present invention.
Figure 12:
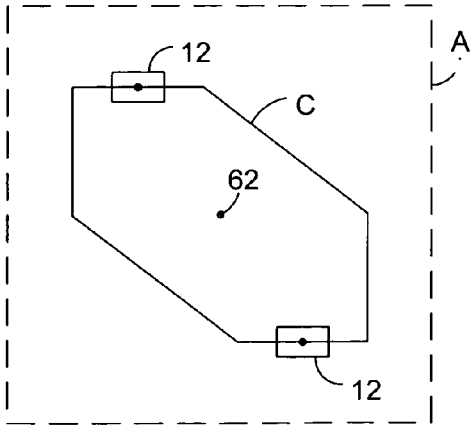
FIG. 12 is a schematic representation of a predefined rectilinear pedal path according to another embodiment of the present invention.
Figure 13:
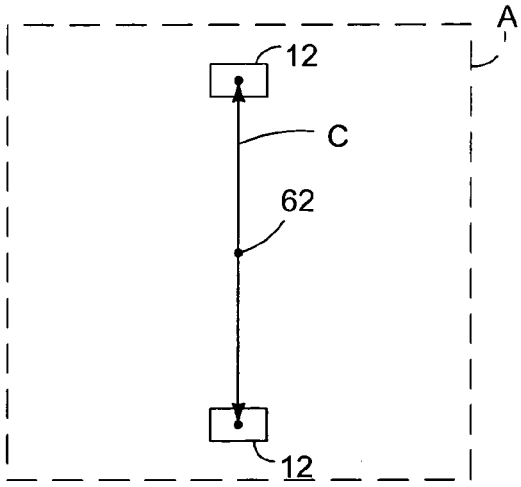
FIG. 13 is a schematic representation of a predefined linear vertical pedal path according to another embodiment of the present invention.
Figure 14:
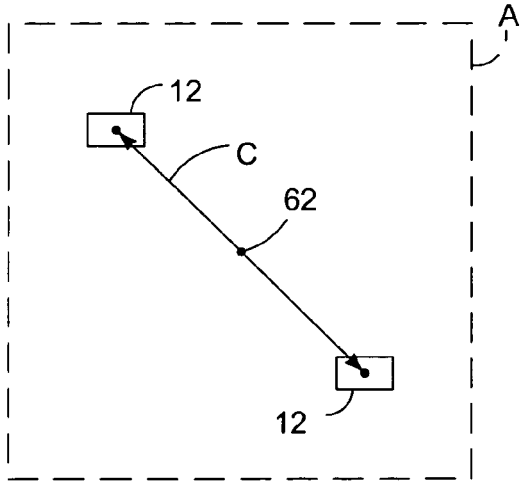
FIG. 14 is a schematic representation of a predefined linear diagonal pedal path of the present invention.
Figure 15:
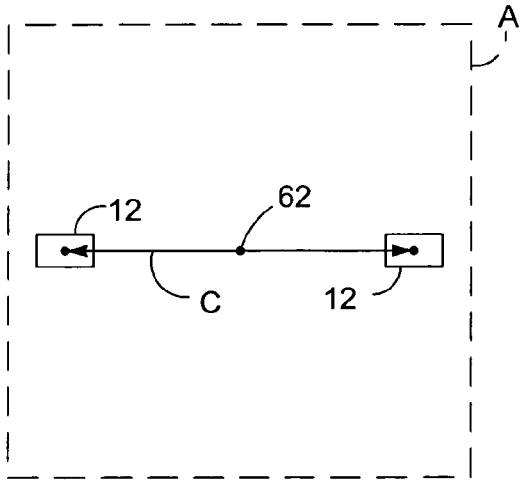
FIG. 15 is a schematic representation of a predefined linear horiztonal pedal path of the present invention.

Exemplary predefined pedal paths are shown in FIGS. 7–15. The pedal path may be in parallelogram form, as shown in FIG. 7, circular or elliptical form, as shown in FIG. 8, peanut-shaped form, as shown in FIG. 9, spiral form of increasing or decreasing radius, as shown in FIG. 10, rectilinear form, as shown in FIG. 11, hexagonal form, as shown in FIG. 12, vertical form, as shown in FIG. 13, diagonal form, as shown in FIG. 14, and horizontal form, as shown in FIG. 15. The resistance subsystem may be configured to constrain the motion of the pedals to predetermined pedal paths such as these, and also to apply a resistance force acting against the motion of the pedals along these paths, which resistance force may be variable or static.

Exercise apparatus 10 typically includes two handles, moving handles 23 and fixed handle 27. Moving handles 23 included pole segments 23*a*, 23*b*, which are linked by pivot joint 23*c* and attached to pedal support assembly 16 and pedal 12 by pivot joints 23*d*, 23*e*, respectively. Moving handles 23 can be moved back and forth by the arms of user 21, in order to exercise the upper body. When the user does not desire to exercise the upper body, the fixed handle 27 may be held by the user to help with support and balance.

Exercise apparatus 10 may be adapted to include a home position to which pedals 12 return after use. The pedals may be configured to return automatically to the home position after use, or may return only upon selection of a "home" button on keyboard 94. The home position may be at the geometric center 62, or may be at some other predefined location within range of motion A. For example the home position may be set such that one of the pedals is low to the ground to enable a user to climb onto and off of apparatus 10. Apparatus 10 may include a mechanical biasing device configured to bias the pedals to the home position, such as springs or torsion members. Alternatively, the apparatus may be configured to return the pedals to the home position via the resistance drives, or other electronic motor or drive mechanism. The home positions for the left and right pedals may be different from each other.

Figure 21:
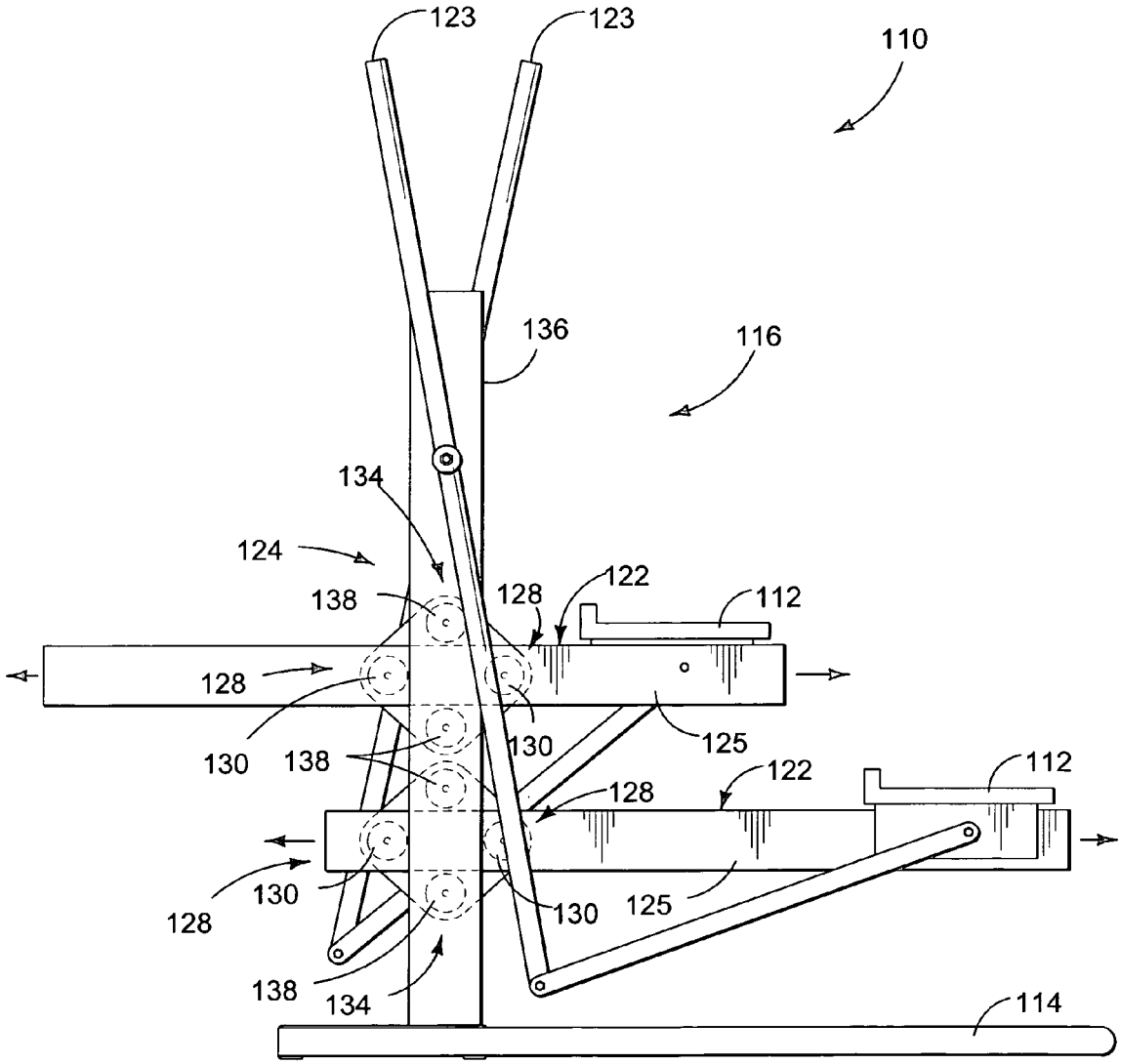
FIG. 21 is a side view of an exercise apparatus according to another embodiment of the present invention.

Referring to FIG. 21, an alternative embodiment of the exercise apparatus of the present invention is shown generally at 110. Apparatus 110 includes a pedal support assembly 116, a horizontal guide assembly 122, and a vertical guide assembly 124, which perform functions similar to corresponding mechanisms in the above-described embodiment.

Pedals 112 of apparatus 110 are attached in a fixed position to the horizontal guides 125 of the horizontal guide assembly 122. Horizontal roller assembly 128 includes wheels 130, which are coupled to vertical guide assembly 124. Horizontal motion is achieved when horizontal guides 125 slide relative to vertical guide 136.

The vertical roller assemblies 134 are typically formed integrally with horizontal roller assemblies 128. Vertical motion of pedals 112 is achieved when vertical roller assemblies 134 travel up and down vertical guides 136. As the vertical roller assemblies move up and down, so do horizontal guide assemblies 125 and pedals 112.

Figure 22:
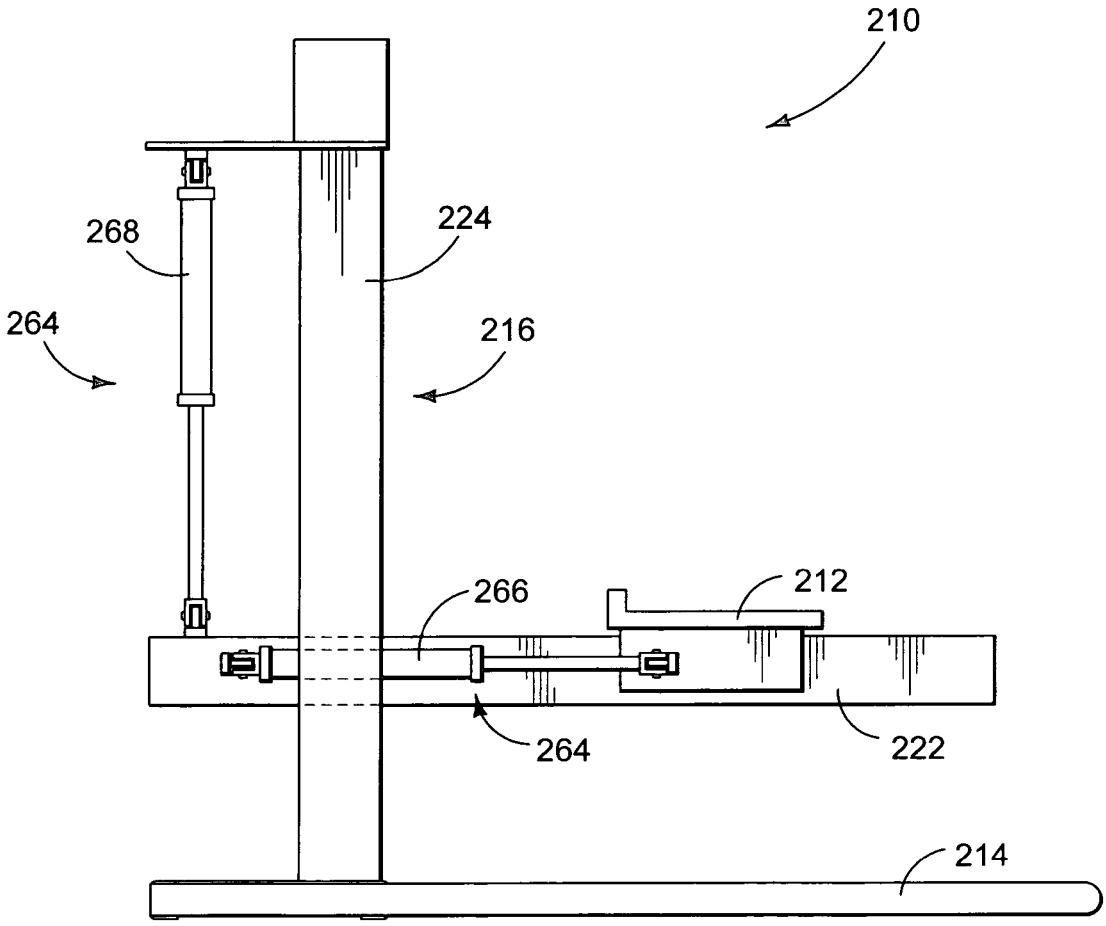
FIG. 22 is a side view of an exercise apparatus utilizing hydraulic cylinders according to yet another embodiment of the present invention.

Turning to FIG. 22, another embodiment of an exercise apparatus according to the present invention is shown generally at 210. Exercise apparatus 210 includes a resistance subsystem 264 incorporating hydraulic resistance mechanisms. Resistance subsystem 264 includes vertical hydraulic resistance mechanism 268 and horizontal hydraulic resistance mechanism 266. Typically, the hydraulic resistance mechanisms are hydraulic cylinders with associated pistons that resist longitudinal back and forth motion. As user 21 pushes horizontally back and forth and vertically up and down on pedals 212, the hydraulic cylinders resist the motion of the pedals, thereby giving the user a strenuous workout. Like the other embodiments discussed above, apparatus 210 includes frame 214, pedal support assembly 216, vertical guide assembly 224, and horizontal guide assembly 222. Each of these components operate in a similar manner to that for corresponding components described above.

Figure 23:
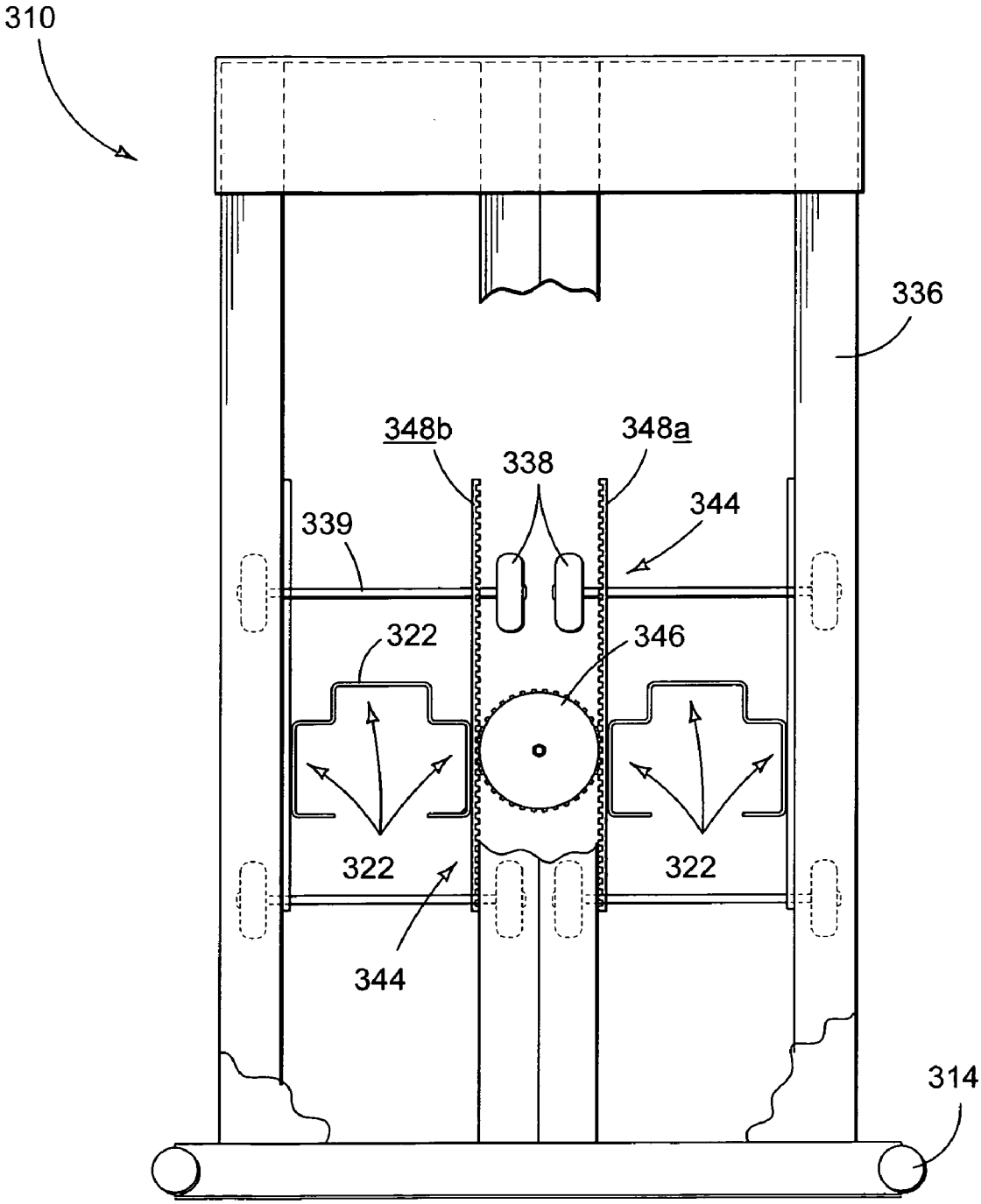
FIG. 23 is an end view of an exercise apparatus having a vertical rack and pinion motion translation mechanism, according to yet another embodiment of the present invention.
Figure 24:
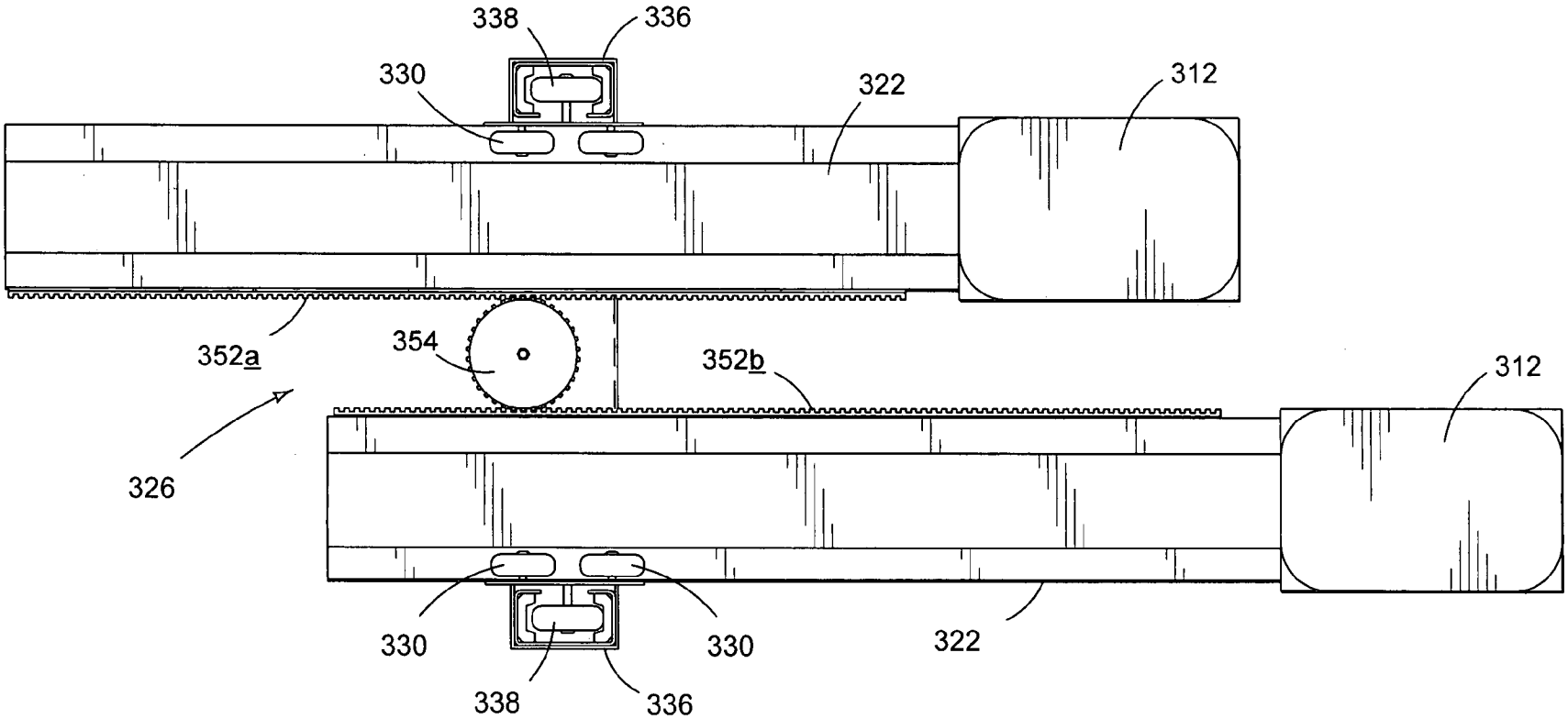
FIG. 24 is a top view of the exercise apparatus of FIG. 23, showing a horizontal rack and pinion motion translation mechanism.

Another embodiment of the present invention is shown in FIGS. 23 and 24, and indicated generally at 310. Apparatus 310 includes a motion translation mechanism having a rack and pinion mechanism. In FIG. 23, a portion of exercise apparatus 310 is shown illustrating a vertical motion translation linkage 344. Vertical motion translation linkage 344 includes vertical racks 348*a* and 348*b*, and a vertical pinion gear 346. Horizontal guides 322 are attached to vertical racks 348*a* and 348*b*, and the vertical racks engage the pinion gear 346. As rack 348*a* travels upward, the pinion gear 346 rotates causing the rack 348*b* to travel downward.

FIG. 24 illustrates horizontal guide assemblies 322 and the rack and pinion of the horizontal motion translation linkage 326. Horizontal motion translation linkage 326 includes racks 352*a* and 352*b*, and pinion 354. Apparatus 310 includes pedals 312, horizontal guide assembly 322, horizontal rollers 330, vertical rollers 338, and vertical guides 336. As rack 352*a* moves in one direction pinion 354 rotates causing rack 352*b* to move in the opposite direction.

According to another embodiment of the invention a method of moving pedals on an exercise apparatus is provided. The method typically includes configuring the pedals for free motion within a predefined range of motion. The pedals are typically configured for free motion using the vertical and horizontal guide assemblies described above. The method further includes constraining the motion of the pedals to a predefined pedal path within the predefined range of motion via a selectively applied resistance force. The resistance force is typically applied via the resistance subsystem, described above.

The embodiments of the present invention may be used to enable a user to exercise by moving pedals freely horizontally, vertically, or simultaneously horizontally and vertically along an arbitrary pedal path, or along a static or varying predefined pedal path, within a predefined range of motion, thereby eliminating the injury and tedium associated with prior devices.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

I claim:

1. An exercise apparatus, comprising:

a frame;

a pedal support assembly; and left and right pedals interconnected to the frame by the pedal support assembly and adapted to be moved in any one of the following ways:

(1) in a substantially vertical direction;

(2) in a substantially horizontal direction; and (3) simultaneously in a substantially vertical direction and a substantially horizontal direction;

wherein the pedal support assembly includes:

a horizontal guide assembly configured to enable the pedals to move in a horizontal direction;

a vertical guide assembly configured to enable the pedals to move in a vertical direction; and a motion translation mechanism configured to link the pedals to move reciprocally; and wherein the motion translation mechanism further includes:

a resistance subsystem configured to apply a resistance force to act against the movement of each of the pedals; and a controller configured to selectively adjust the resistance applied by the resistance subsystem.

2. An exercise apparatus, comprising:

a frame;

a pair of pedals interconnected to the frame by a pedal support assembly;

a horizontal motion translation linkage coupled to each of the pedals and configured to link the horizontal motion of the pedals; and a vertical motion translation linkage coupled to each of the pedals and configured to link the vertical motion of the pedals, wherein the pedal support assembly includes vertical guides coupled with horizontal guides.

3. An exercise apparatus, comprising:

a frame;

a pedal interconnected to the frame;

a horizontal guide configured to guide horizontal motion of the pedals; and a vertical guide configured to guide vertical motion of the pedal coupled with the horizontal guide.

4. An exercise apparatus, comprising:

a frame;

a pair of pedals interconnected to the frame by a pedal support assembly having a vertical guide member coupled with a horizontal guide member, the pedals being configured to move forwardly and rearwardly in a horizontal direction and up and down in a vertical direction to any point within a predefined range of motion including a horizontal dimension and a vertical dimension; and a resistance subsystem configured to constrain movement of the pedals to a predefined path within the predefined range of motion.

5. The apparatus of claim 4, wherein the resistance subsystem includes an electromechanical resistance drive.

6. The apparatus of claim 4, wherein the predefined path is selected from the group consisting of circular pedal path, elliptical pedal path, parallelogram pedal path, linear pedal path, curvilinear pedal path, vertical pedal path, horizontal pedal path, diagonal pedal path, spiral pedal path, and rectilinear pedal path.

7. The exercise apparatus of claim 2, wherein the vertical guides couple with the horizontal guides by vertical roller assemblies.

8. The exercise apparatus of claim 7, wherein the vertical roller assemblies include mounting plates configured to support wheels and attach to the horizontal guides.

9. The exercise apparatus of claim 8, wherein the vertical guides are configured to accommodate wheels from the vertical roller assemblies and guide the vertical motion of the vertical roller assemblies.

10. The exercise apparatus of claim 7, wherein the pedals are fixedly mounted to the horizontal guides and the horizontal guides are configured to slide horizontally relative to the vertical guides.

11. The exercise apparatus of claim 2, wherein the horizontal motion translation linkage includes shafts coupled via ball spline joints and flexible tensile members to reciprocally link the horizontal motion of the pedals.

12. The exercise apparatus of claim 2, wherein the vertical motion translation linkage includes a flexible tensile member and rotating gears to reciprocally link the vertical motion of the pedals.

13. The exercise apparatus of claim 3, further comprising:

a horizontal motion translation linkage coupled to each of the pedals and configured to link the horizontal motion of the pedals; and a vertical motion translation linkage coupled to each of the pedals and configured to link the vertical motion of the pedals.

14. The exercise apparatus of claim 13, wherein the vertical guide is coupled with the horizontal guide by a vertical roller assembly.

15. The exercise apparatus of claim 3, wherein the vertical guide is coupled with the horizontal guide by a vertical roller assembly.

16. The exercise apparatus of claim 15, wherein the vertical roller assembly includes wheels configured to travel along the vertical guide and a mounting plate configured to support the wheels and couple the vertical roller assembly to the horizontal guides.

17. The exercise apparatus of claim 4, wherein the vertical guide member is coupled with the horizontal guide member by a vertical roller assembly.

18. The exercise apparatus of claim 17, wherein the vertical roller assembly includes wheels configured to travel along the vertical guide and a mounting plate configured to support the wheels and couple the vertical roller assembly to the horizontal guides.

* * * * *